United States Patent [19]

Goursau

[11] 3,943,816

[45] Mar. 16, 1976

[54] GUITAR NECK

[75] Inventor: Daniel R. Goursau, San Francisco, Calif.

[73] Assignee: The Raymond Lee Organization, Inc., New York, N.Y. ; a part interest

[22] Filed: May 12, 1975

[21] Appl. No.: 576,601

[52] U.S. Cl. ..... 84/293; 84/452 R
[51] Int. Cl.[2] ..... G10D 3/00
[58] Field of Search ..... 84/267, 293, 452

[56] References Cited

UNITED STATES PATENTS

| | | | |
|---|---|---|---|
| 446,450 | 2/1891 | Heyder | 84/452 R |
| 600,507 | 3/1898 | Bremerman | 84/293 |
| 2,795,988 | 6/1957 | Maccaferri | 84/293 |
| 3,805,663 | 4/1974 | Okugawa | 84/293 |

*Primary Examiner*—Lawrence R. Franklin
*Attorney, Agent, or Firm*—Howard I. Podell

[57] ABSTRACT

A guitar neck which is cast of epoxy resin and a powdered filler, preferably of aluminum metal. This guitar neck, when fastened to a conventional guitar, is of greater strength than conventional laminate wood guitar necks and may be consequently formed of thinner construction, simplifying the playing and fingering of the guitar strings fitted on the neck.

3 Claims, 5 Drawing Figures

GUITAR NECK

SUMMARY OF THE INVENTION

My invention is a guitar neck which is cast of epoxy resin and a powdered filler, preferably of aluminum metal. This guitar neck, when fastened to a conventional guitar, is of greater strength than conventional laminate wood guitar necks and may be consequently formed of thinner construction, simplifying the playing and fingering of the guitar strings fitted on the neck.

The guitar neck of this invention may be employed on electric or acoustic guitars.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
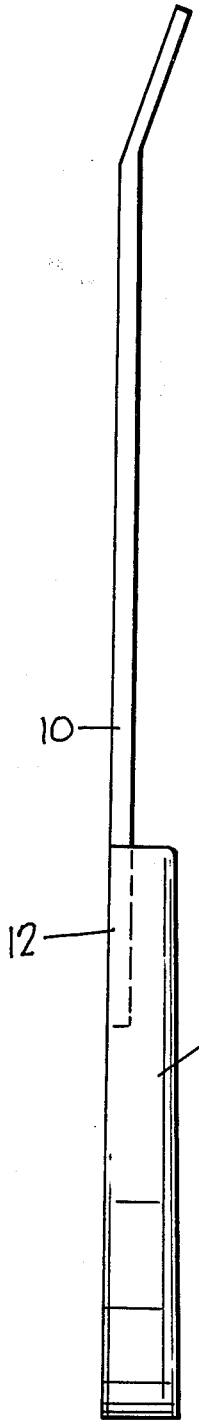
FIG. 1 is a side view of the invention installed on a guitar.
Figure 2:
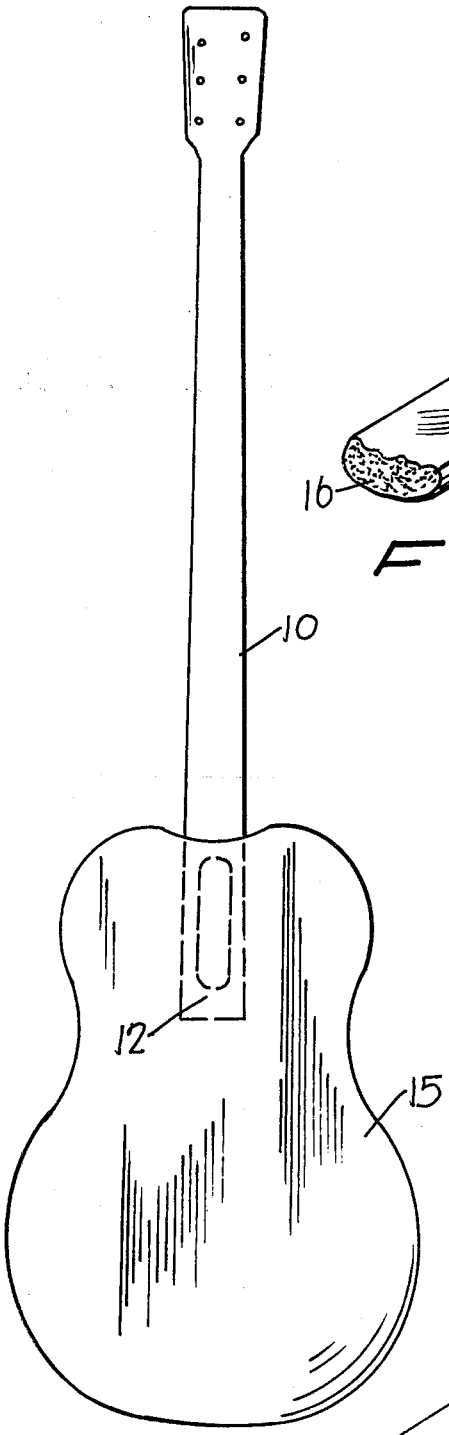
FIG. 2 is a plan view of the invention installed.
Figure 3:
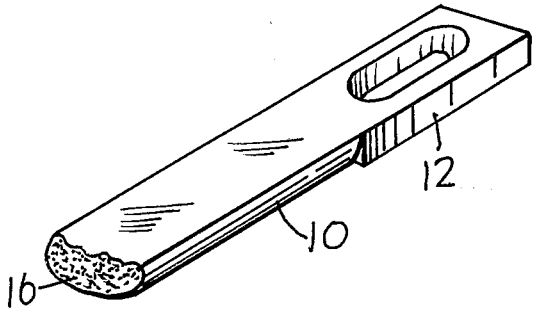
FIG. 3 is a fragmentary perspective view of the butt end of the invention.
Figure 4:
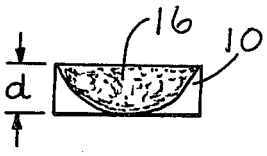
FIG. 4 is a sectional view of the invention.
Figure 5:
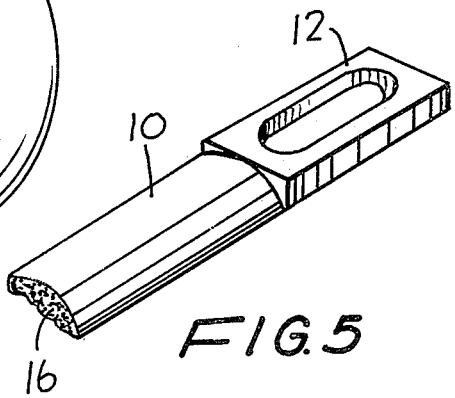
FIG. 5 is a fragmentary perspective view of the underside of the butt end of the invention.

Turning now descriptively to the drawings, in which similar reference characters denote similar elements throughout the several views, FIGS. 1–5 illustrate the guitar neck 10 which is of conventional shape and fitted at its butt end 12 into the body 15 of a guitar in customary fashion.

The guitar neck 10 is formed as a casting of a mixture 16 of epoxy resin and powdered filler, preferably aluminum metal powder.

The cast neck 10 may be manufactured more inexpensively and more rapidly than the conventional wooden guitar necks that it replaces.

Since obvious changes may be made in the specific embodiment of the invention described herein, such modifications being within the spirit and scope of the invention claimed, it is indicated that all matter contained herein is intended as illustrative and not as limiting in scope.

Having thus described the invention what I claim as new and desire to secure by letters patent of the United States is:

1. A guitar neck consisting of a mixture of an epoxy resin and a powder filler.

2. The combination as recited in claim 1 in which powdered aluminum metal is employed as the filler.

3. The guitar neck of claim 1 wherein the neck is fabricated by casting.

* * * * *